United States Patent [19]

Kamelreiter et al.

[11] Patent Number: 4,728,285

[45] Date of Patent: Mar. 1, 1988

[54] DEVICE FOR THE COMBUSTION OF FLUID COMBUSTIBLE MATERIALS

[75] Inventors: Friedrich Kamelreiter; Josef Landauf; Adalbert Marko, all of Vienna, Austria; Helmut Bormann, Sehnde, Fed. Rep. of Germany; Jochen Bosse; Werner Kirschning, both of Hanover, Fed. Rep. of Germany; Dieter Lischitzki, Neustadt; Detlef Zwetz, Isernhagen, both of Fed. Rep. of Germany

[73] Assignees: Dumag Offene Handelsgesellschaft Dr. Techn. Ludwig Kaluza & Co., Vienna, Austria; **Karl-Chemie*,** Hanover, Fed. Rep. of Germany

[21] Appl. No.: 814,106

[22] Filed: Dec. 27, 1985

[30] Foreign Application Priority Data

Jan. 25, 1985 [AT] Austria ..... 198/85

[51] Int. Cl.[4] ..... F23C 7/00

[52] U.S. Cl. ..... 431/187; 431/351; 239/102.1; 239/422; 239/424

[58] Field of Search ..... 431/1, 181, 187, 351; 239/4, 102.1, 419.3, 422, 423, 424, 424.5

[56] References Cited

U.S. PATENT DOCUMENTS

| | | | |
|---|---|---|---|
| 3,174,527 | 3/1965 | Reed et al. | 431/181 |
| 3,748,087 | 7/1973 | Shular | 431/351 X |
| 3,908,904 | 9/1975 | Kerner et al. | 239/4 |
| 3,936,275 | 2/1976 | Perret et al. | 431/351 X |
| 4,351,632 | 9/1982 | Nagai | 431/351 X |
| 4,544,095 | 10/1985 | Litzen | 239/422 X |
| 4,616,784 | 10/1986 | Simmons et al. | 239/424 X |

FOREIGN PATENT DOCUMENTS

| | | | |
|---|---|---|---|
| 0141932 | 12/1978 | Japan | 431/351 |

*Primary Examiner*—Margaret A. Focarino

*Attorney, Agent, or Firm*—Karl F. Ros; Herbert Dubno

[57] ABSTRACT

A device for the combustion of fluid materials, especially particulate (i.e. powdered or granular) solid fuels, suspended in a fluid medium, for example coal suspended in water, with a nozzle and a combustion chamber. The nozzle is located in a precombustion chamber opening into the combustion chamber, and the device directs a minor part of the combustion air to the region of the orifice of the nozzle in the precombustion chamber, and a major part of the combustion air to the region of the mouth of the precombustion chamber where it opens into the combustion chamber.

7 Claims, 4 Drawing Figures

DEVICE FOR THE COMBUSTION OF FLUID COMBUSTIBLE MATERIALS

SPECIFICATION

1. Field of the Invention

The present invention relates to a device and a nozzle for use in the device, for the combustion of fluid combustible materials, especially particulate materials such as powdered or granular solid fuels suspended in a fluid, for example coal in dust or granular form suspended in water.

2. BACKGROUND OF THE INVENTION

Various technologies for the combustion of pulverised coal are known. The special difficulties in the combustion of pulverized coal are, however, that a high explosion risk is caused by dry storage of pulverized coal. In order to avoid this risk, it has been proposed to suspend pulverised coal in water. However, the combustion of pulverized coal suspended in water causes problems because this mixture is very difficult to ignite.

Known devices for the combustion of materials, such as pulverized coal suspended in a fluid medium such as water, which are difficult to ignite and difficult to burn have been found to be unsatisfactory not only due to the difficulties encountered in the ignition of such combustible material, but also in the maintenance of a stable flame once the ignition has been achieved. Moreover, in the prior art complete combustion of such materials has not been obtained, and nozzles used in burners for such materials have had only a relatively short service life.

Such combustible fluid media is disclosed in German Offenlegungsschrift No. 1 964 040 which describes several different arrangements of nozzles for mixing and atomising at least two fluid media, especially for preparing combustible mixtures of fluid media. In particular, the nozzle shown in FIG. 4 of Offenlegungsschrift No. 1 964 040 is intended for atomizing a fluid medium, in particular pulverized coal suspended in a fluid such as water, by means of a gas or a mixture of gses such as air, with two annular nozzles arranged coaxial to one another on the end face of an approximately hollow cylindrical housing, a likewise approximately hollow cylindrical insert piece, and, located in the interior of the nozzle housing, an axially aligned central shaft formed with an impingement plate on a free end which projects outside the nozzle housing. The inner surface of the nozzle housing forms a first, outer flow channel of annular cross-section for a first fluid medium, and around the shaft is formed a second flow channel, located radially inwardly of the outer flow channel, and likewise of annular cross-section, for a second fluid medium. This known nozzle does not operate satisfactorily, however, when the material to be atomized is ignitable only with difficulty as is the case, for example with pulverized coal suspended in water.

OBJECT OF THE INVENTION

The object of the present invention is to provide a device for the combustion of fluid combustible materials, especially those which are difficult to ignite or difficult to burn, such as, for example, coal particles suspended in a medium such as water, by means of which the disadvantages inherent in the known devices may be overcome.

SUMMARY OF THE INVENTION

According to the invention, there is provided a device for the combustion of fluid materials, in particular particulate solid fuels suspended in a fluid, such as coal particles suspended in water, with an ultrasonic atomization nozzle and a combustion chamber, in which the nozzle is located in a precombustion chamber which opens into the combustion chamber and there are means for directing a minor part of the combustion air into the precombustion chamber and means for directing a major part of the combustion air to the region of the mouth of the precombustion chamber opening into the combustion chamber. Preferably, the precombustion chamber is generally cylindrical and has a length which is between approximately one and a half and four times its diameter. According to a further preferred feature, an annular duct, from which cross ducts emanate which end in the region of the transition from the precombustion chamber into the combustion chamber, is provided in the wall or outside the wall of the precombustion chamber.

In use of such a device, the fluid combustible material is sprayed through the nozzle into the precombustion chamber where a less than stoichiometric combustion takes place, by means of which the material is preliminarily heated, due to the fact that only a minor part of the air required for complete combustion of the material is introduced .into the precombustion chamber. The combustible material is mixed in the precombustion chamber not only with air but also with combustion gases flowing back from the combustion chamber, and with partially burned fuel particles so that a readily combustible oxidation product is formed which, after it has passed from the precombustion chamber into the combustion chamber, ensures that an optimum burning process takes place when the air required for complete combustion is introduced.

Optimization of the combustion process is thus ensured partly by achieving the high temperatures required for complete combustion and partly by good mixing of the combustible material with the air required for the combustion. Since the flame of stoichiometric combustion does not form on the precombustion chamber nozzle but only at the transition between the precombustion chamber and the combustion chamber, the nozzle is not subjected to high thermal stresses and stresses due to oxidation and its service life is therefore significantly extended. Moreover, the occurrence of temperature peaks (which cause the formation of nitrogen oxides) is avoided by such a precombustion and subsequent main combustion, so that the combustion is characterized by a low formation of nitrogen oxides.

The different conditions required for different fuels can be obtained by controlling the combustion air fed to the precombustion chamber and/or to the combustion chamber and additionally by the selection of the size of the precombustion chamber.

In the case of water-containing products, such as coal/water suspensions, the water evaporates in the precombustion chamber, so that the cooling effect thus caused takes place in the precombustion chamber and not in the combustion chamber. As a result, it is possible to burn such materials in conventional combustion boilers, without feeding additional fuels for this purpose - as was hitherto necessary.

According to another aspect of the present invention, there is provided a nozzle for atomising a fluid medium, in particular particulate coal suspended in a fluid such as water, by means of a gas or a gas mixture such as air, having two annular nozzle orifices arranged coaxially at one end of an approximately cylindrical hollow nozzle housing within which is located an approximately cylindrical hollow insert piece, and, in the interior thereof, an axially aligned central shaft, formed with an impingement plate on its free end, the inner surface of the nozzle housing defining an outer first flow channel of annular cross-section for a first fluid medium and located inside the outer flow channel and surrounding the shaft, is an inner, second flow channel, also of annular cross-section, for a second fluid medium, in which the outer flow channel ends in an annular groove which is provided in the region of the free end of the insert piece and is open outwards at an angle to the longitudinal axis of the nozzle housing and which acts as a vibration generator and communicates directly with the first annular nozzle orifice, a second insert piece being arranged between the said insert piece and the shaft, and a first annular space being formed between the inner surface of the first insert piece and the outer surface of the second insert piece, which annular space communicates, via at least one passage, with the inner, second flow channel surrounding the shaft.

Preferably, the second insert piece is held between a first annular shoulder face, provided on the inner surface of the first insert piece, and a second annular shoulder face provided on the outer surface of the shaft. Moreover, the shaft can be provided in its end region facing away from the free end of the nozzle housing with a significantly enlarged cross-section and, in this end region, a central bore is provided from which emanates at least one obliquely outward-running channel which leads into the inner flow channel surrounding the shaft.

According to a further preferred feature, the second insert piece is formed with at least one group, or several groups located at axial mutual spacings, of channels which are directed transversely to the axis and start from the first annular space and end in the inner flow channel, surrounding the shaft, tangentially to its outer wall. Furthermore, an axially adjustable sleeve with a cylindrical annular surface projecting beyond the surface of the nozzle orifices can be arranged in a manner known per se on the outer wall of the nozzle housing. The impingement plate located on the free end of the shaft can be releasably fixed thereto.

Various other features and advantages of the present invention will become apparent from a study of the following detailed description in which reference is made to the accompanying drawings, and which are provided purely by way of non-limitative example.

DESCRIPTION OF THE PREFERRED EMBODIMENTS

Figure 1:
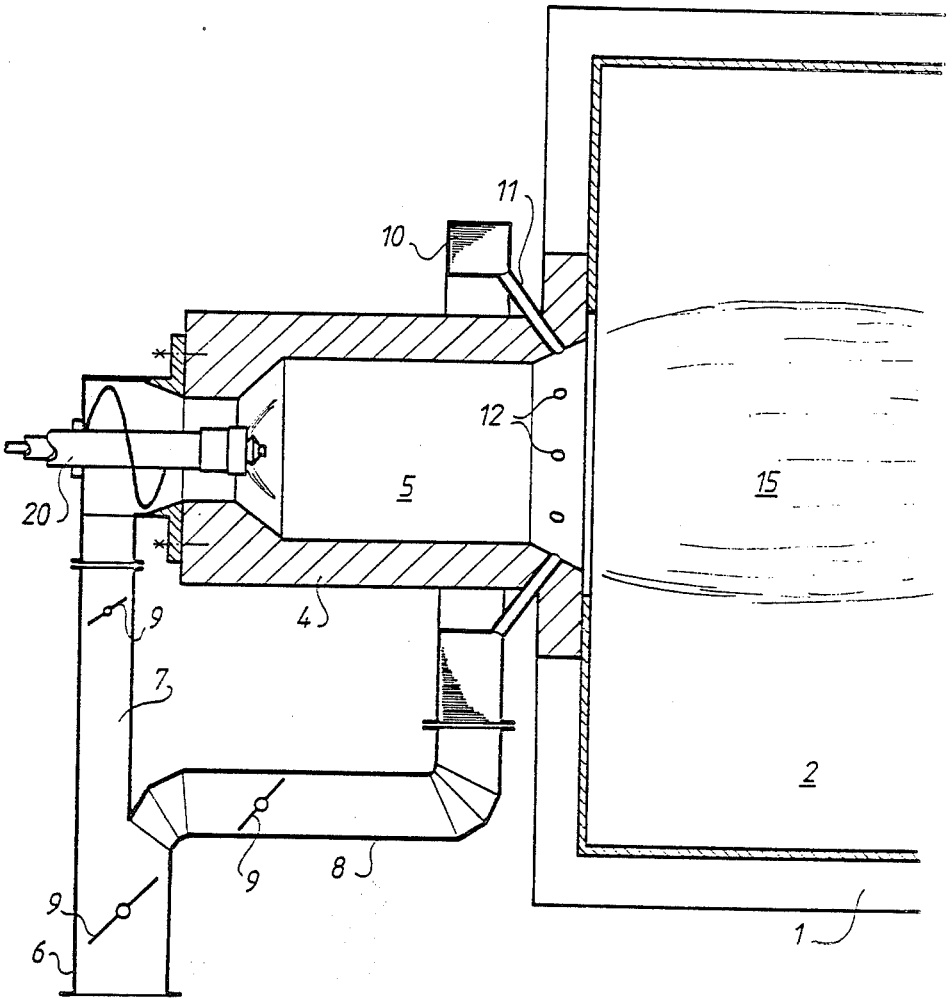
FIG. 1 is an axial section of a device for the combustion of flowable materials.

Referring now to the drawings, the device shown in FIG. 1 is a burner for the combustion of fluid materials, in particular pulverized or granular solid fuels suspended in a fluid medium such as water. The device shown comprises a burner chamber 1 which encloses a combustion space 2 for the combusion of combustible materials introduced through a nozzle 20.

In contrast to conventional technology, the burner nozzle 20 does not project into the combustion space 2, but, instead, there is provided an additional precombustion chamber 4 which encloses a precombustion space 5 and the burner nozzle 20 projects into the precombustion space 5. A first air duct 7 directs a first part of the combustion air to the precombustion chamber 4 in the region of the orifice of the nozzle 20, and a second part of the combustion air is fed via a second air duct 8, an annular duct 10 and cross ducts 11 to nozzles 12, which are spaced around the mouth of the precombustion chamber 4 opening into the combustion chamber 1. By far the major part of the combustion air required for complete combustion in fed via the second air duct 8 to the nozzles 12. The two air ducts 7 and 8 are fed by a main air duct 6 and this, as well as the air ducts 7 and 8, is provided with butterfly valves 9 by which control of the air feed can be effected in accordance with requirements.

The operation of the combustion device described above is as follows:

A fluid combustible material, such as coal particles suspended in a fluid medium, for example, water, is introduced in a very finely atomized state through the burner nozzle 20 into the precombustion chamber 4. A small part of the air required for combustion is also introduced into the precombustion space 5, through the first air duct 7 in the region of the orifice of the nozzle 20. In the precombustion space 5, in which a preparation, namely mixing, ignition and heating of the combustible materials takes place, a less than stoichiometric combustion of the introduced combustible materials occurs due to the fact that insufficient combustion air is available. This nevertheless preheats the combustible materials and in the precombustion chamber 5 the partly burned combustible materials are intensively mixed with air entering around the nozzle 20, with flue gases entering from the combustion chamber 2, and with partially burned fuel particles. This leads to a so-called "preparation" of the combustible materials for optimization of the burning process when they reach the combustion chamber 2. At the mouth of the precombustion chamber 5 this fuel thus conditioned is transferred into the combustion chamber 2, and at the same time the quantities of air required for complete combustion are introduced via the second air duct 8, the annular duct 10, the cross ducts 11 and the ring of nozzles 12. As a result, a stable flame 15 is formed in the combustion chamber 2 in which complete combustion of the combustible materials takes place with establishment of the temperatures required for this purpose.

The ratio of the proportions of air fed to the precombustion chamber 5 and the combustion chamber 2 may lie between the range of 5% to the precombustion chamber 5 and 95% to the combustion chamber 2 and 40% to the precombustion chamber and 60% to the combustion chamber. Preferably, however, these proportions lie in the range of about 10% to 90% and 30% to 70% respectively.

Figure 2:
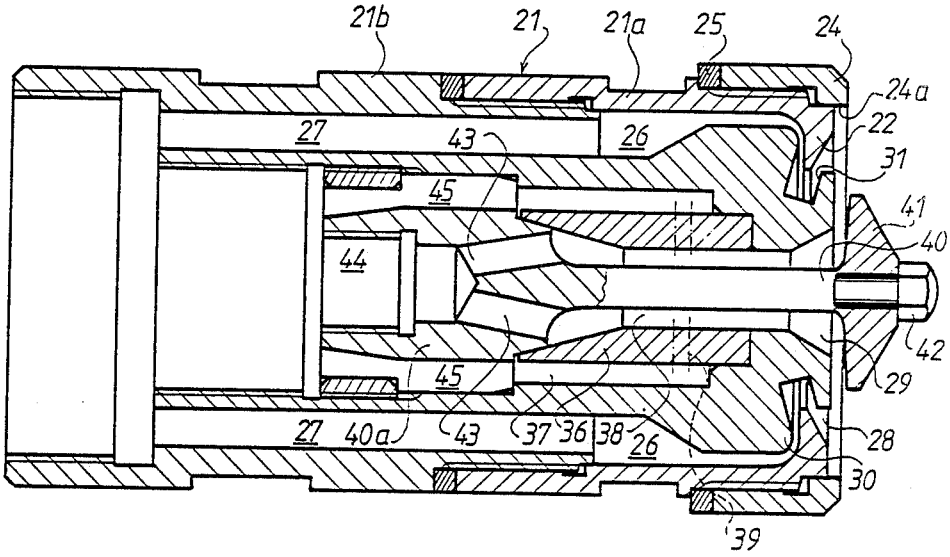
FIG. 2 is an axial section of a nozzle suitable for use in the device of FIG. 1.

FIG. 2 illustrates a nozzle for use in the burner of FIG. 1 which comprises a hollow, cylindrical nozzle housing 21 formed by two housing parts 21*a* and 21*b* which are screwed together, the housing part 21*a* associated with the nozzle orifice being formed at its free end with an inwardly-directed flange 22. A hollow, cylindrical insert piece 30 is inserted into the nozzle housing 21. Within the insert piece 30 there is a shaft 40 the free end of which projects from the insert piece and is formed with an impingement plate 41. In the annular space between the shaft 40 and the inner surface of the insert piece 30 there is located a second insert piece 36 which divides this annular space into two coaxial annular spaces 37 and 38. The second insert piece 36 is held between a first shoulder on the inner wall of the first insert piece 30 and a second shoulder provided on a widened base 40*a* of the shaft 40. Moreover, the first insert piece 30 is formed, in the front region of the nozzle housing 21, with a groove 31 which is open towards the front, at an angle to the nozzle axis, and into which the annular flange 22 projects.

Between the inner wall of the nozzle housing 21 and the outer wall of the first insert piece 30, there is a first flow channel 26 of annular cross-section, which is deflected inwards by the annular flange 22 and leads into the groove 31 located in the first insert piece 30. Between the flange 22 and the outer wall of the first insert piece 30, a first annular nozzle orifice 28 is formed. Between the inner wall of the first insert piece 30 and the outer wall of the second insert piece 36, a first annular space 37 is formed which is connected via channels 39, provided in the second insert piece 36 and running transversely, to the second annular space 38 surrounding the shaft 40. The second annular space 38 leads into a second annular nozzle orifice 29. The radially outer first flow channel 26 is fed through a first annular channel 27. The first annular spce 37 is fed through a second annular channel 45 located concentrically within the first annular channel 27, and the second annular spce 38 is fed through oblique passages 43 formed in the base 40*a*, of widened cross-section, of the shaft 40 from a central channel 44.

On the front of the housing part 21*a*, a sleeve 24 is fitted which is formed with a cylindrical edge 24*a* surrounding the plane of the concentric annular nozzle orifices 28 and 29. The position of the sleeve 24 relative to the housing part 21*a* is adjustable by means of a spacer ring 25. The impingement plate 41 carried on the free end of the shaft 40 is in fact formed as a component which is separate from the shaft 40 and which is fixed to the shaft 40, for example by means of a screwed sleeve or dome nut 42.

Figure 3:
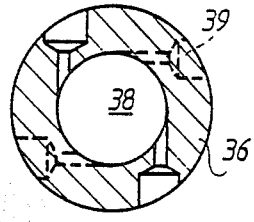
FIG. 3 is a cross-section taken on the line 3—3 of FIG. 2 showing a component of the nozzle of FIG. 2.

As can be seen from FIG. 3 of the drawing, the transverse channels 39 formed in the second insert piece 36 lie in a plane perpendicular to the axis of the insert piece itself and lead into the second annular space 38 tangentially to the outer wall thereof.

The operation of the nozzle described hereinabove is as follows:

The radially innermost central channel 44 is supplied with a first fluid material, for example a coal/water suspension, which passes through the bores 43 into the second annular space 38 surrounding the shaft 40. The second annular channel 45 is supplied with a pressure medium, for example a compressed gas such as compressed air. This enters the first annular space 37 and passes through the transverse passages 39 into the second annular space 38 in which, due to the tangential arrangement of the passages 39 intensive turbulence and mixing of the fluid media present therein takes place. Due to the pressure prevailing in the second annular space 38, this mixture is delivered axially forwards and passes through the radially innermost, second annular nozzle orifice 29 to strike the inside of the impingement plate 41, where it is delivered radially outwards while retaining its spinning movement.

Through the radially outermost, first annular channel 27 and the adjoining first flow channel 26, a second pressure medium is delivered, which enters the groove 31 at the front end of the flow channel 26, whereby, because the groove 31 acts as a Hartmann vibration generator, a vibrational field is generated, by means of which the mixture emerging from the radially inner, second annular space 38 through the inner, second annular nozzle orifice 29 is very finely atomised and discharged in the form of a cone away from the nozzle. The shape of the nozzle cone can be influenced by the axial position of the sleeve 24 and/or by the size of the cylindrical inner surface 24*a* of the sleeve 24.

Since the impingement plate 41 is releasably fixed to the shaft 40, it can be made of a very hard and resistant material and can be replaced in the case of wear. The shaft 40 also effects intense cooling of the impingement plate 41. Moreover, because the impingement plate 41 is carried by the centrally arranged shaft 40, the inner, second annular nozzle orifice 29 is formed without the provision of webs for holding the impingement plate 41 so that the turbulent movement or spinning of the fluid medium emerging through the inner annular nozzle orifice 29 is not interrupted.

Figure 4:
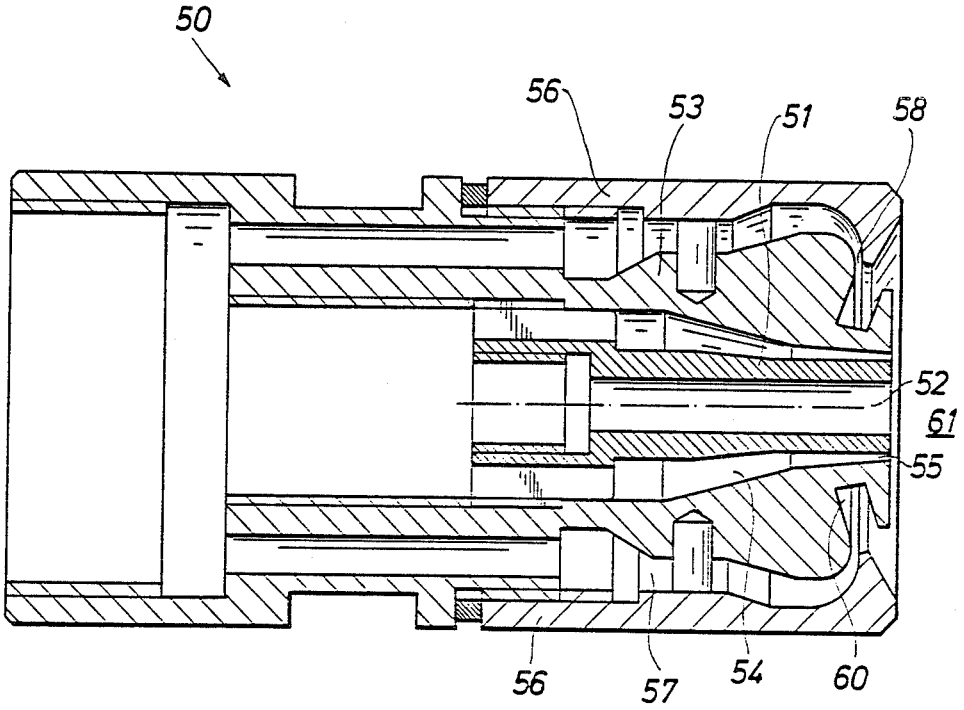
FIG. 4 is an axial section of an alternative nozzle, suitable for use in the device of FIG. 1.

Referring now to FIG. 4, there is shown a nozzle 50 which is particularly suitable for use in the burner device described in relation to FIG. 1. In the centre of this nozzle 50, there is a tubular body 51 with a relatively large nozzle orifice 52 which is suitable for the outflow of a medium which is difficult to burn, for example a pasty medium, which may be supplied to the nozzle by means of a pump. Radially outwardly of the tubular body 51 is a channel 54 of annular cross-section the radially inner wall of which is constituted by the tubular body 51 and the radially outer wall of which is formed by an insert 53. The channel 54 is intended for feeding a readily ignitable combustible fluid, for example a light oil, to an annular outlet orifice 55.

The burner nozzle 50 has an outer nozzle housing 56 within which the insert 53 is received and which defines, with the insert a further channel 57 of annular cross-section which is intended to receive a pressurized gas. The channel 57 terminates in an inwardly curved section and an annular nozzle orifice 58, the outflow direction of which is radially inwards, substantially perpendicular to the axis of the nozzle 50 such that fluid flowing thereform is directed into an annular and circumferential groove 60 which corresponds to the groove 31 in the embodiment of FIG. 2, and which is formed in the insert 53 to act, as in the embodiment of FIG. 2, as a resonator of a Hartmann vibration generator.

As soon as compressed air or compressed gas flows out of the annular orifice 58 at an appropriate velocity and flows into the facing annular circumferential groove 60, a sonic vibration field, in particular an ultrasonic vibration field, is generated in the region 61 located in front of the end wall of the burner nozzle 50. This vibration field has the effect that media issuing from the nozzle orifices 52 and 55 into the vibration field are atomized into microscopically fine particles and are intimately mixed with one another. As a result, the combustible parts of this mixture can burn upon ignition thereof even if relatively large quantities of a non-combustible medium are present in the mixture.

If it is found during the operation of such a burner nozzle that the combustible proportions of the mixture suffice to form a continuous flame, the readily combustible fuel supplied along the channel 54 can be reduced to a minimum. No modifications to the illustrated burner nozzle 50 are necessary if it is desired to use only one combustible material, which can of course be supplied either to the central nozzle 52 or the intermediate nozzle 55.

A burner such as that shown in FIG. 1 has been found to operate very well when fitted with a nozzle such as that described in relation to FIG. 4.

What is claimed is:

1. In a device for the combustin of fluid materials, in particular particulate solid fuels suspended in a fluid, such as coal particles suspended in water, comprising:

a fuel atomization nozzle, a combustion chamber, and means for supplying combustion air to said device, the improvement wherein said fuel atomization nozzle is located in a precombustion chamber having a mouth which opens into said combustion chamber, means for directing a minor part of said combustion air into said precombustion chamber, and means for directing a major part of said combustion air to the region of said mouth of said precombustion chamber opening into said combustion chamber, said fuel atomization nozzle having means defining two annular nozzle orifices coaxially located at one end of an approximately cylindrical hollow nozzle housing, an approximately cylindrical, hollow insert piece located within said housing, an axially aligned central shaft located within said insert piece, an impingement plate on the free end of said central shaft, the inner surface of said nozzle housing defining an outer first flow channel of annular cross-section for a first fluid medium, means defining an inner, second flow channel inside said outer, first flow channel and surrounding said shaft, said inner, second flow channel being of annular cross-section and being provided for a second fluid medium, means defining an annular groove at the end of said outer first flow channel in the region of the free end of said insert piece, said annular groove opening outwards at an angle to the longitudinal axis of said nozzle housing, and acting in use as a vibration generator, and communicating directly with said first annular nozzle orifice, a second insert piece being located between said insert piece and said shaft, means defining a first annular space between the inner surface of said insert piece and the outer surface of said second insert piece, and means defining at least one passage communicating between said first annular space and said inner, second flow channel surrounding said shaft.

2. The device of claim 1 wherein said second insert piece is held between a first annular shoulder on the inner surface of said first insert piece, and a second annular shoulder on the outer surface of an enlarged base of said shaft.

3. The device of claim 1 wherein said shaft has an enlarged base in its end region remote from the free end carrying said impingement plate, said base having a central bore from which extends at least one passage inclined to the axis of said shaft and leading into said inner, second flow channel surrounding said shaft.

4. The device of claim 1 wherein there are a plurality of said passages between said first annular space and said inner, second flow channel surrounding said shaft, said plurality of passages being formed in said second insert piece and lying tangentially with respect to the outer wall of said inner, second flow channel.

5. The device of claim 1 wherein there is further provided an axially adjustable sleeve having a cylindrical annular surface projecting axially beyond the outer wall of said nozzle housing in which said nozzle orifices are formed.

6. The device of claim 1 wherein said impingement plate located on the free end of said shaft is releasably fixed thereto.

7. In a device for the combustion of fluid materials, in particular particulate solid fuels suspended in a fluid, such as coal particles suspended in water, comprising:

a fuel atomization nozzle, a combustion chamber, and means for supplying combustion air to the device, the improvement wherein said fuel atomization nozzle is located in a precombustion chamber having a mouth which opens into said combustion chamber and comprises a nozzle body having three mutually concentric nozzle orifices opening into said precombustion chamber, including:

a first, innermost, nozzle orifice having an axial outlet at an end of said body connected to a means for supplying thereto a viscous liquid fuel mixture to be burned;

a second nozzle orifice outwardly of said first nozzle orifice and connected to a means for delivering a further liquid combustible fuel, said second nozzle orifice coverging toward said first orifice;

a third, outermost, nozzle orifice connected to a means for delivering a pressurized gas to said nozzle body; and means defining a nozzle cavity communicating with said third orifice and provided with a member positioned in the region of said first and second orifices and impinged upon by the pressurized gas flowing from said third orifice so that impact of said pressurized gas upon said member generates an ultrasonic vibration in said cavity which, in the regions of said first and second orifices, causes atomization by said vibration of the fluid fuel mixture emerging from said first orifice and of said further combustible fuel emerging from said second orifice.

* * * * *